United States Patent [19]

Horvath

[11] 4,298,036

[45] Nov. 3, 1981

[54] DISPENSER FOR STICK SOLIDS

[75] Inventor: William Horvath, Watchung, N.J.

[73] Assignee: Plastic Research Products, Inc., Warren, N.J.

[21] Appl. No.: 103,049

[22] Filed: Dec. 13, 1979

[51] Int. Cl.[3] ..... B65B 3/04; B65B 7/28

[52] U.S. Cl. ..... 141/1; 141/113; 53/467; 53/471; 53/489; 29/426.6; 215/200; 215/224; 401/49; 401/55; 222/386.5; 222/390

[58] Field of Search ..... 222/386.5, 390; 53/404, 53/471, 467, 489; 141/1, 2, 18–29, 113; 401/49, 55; 29/426; 215/200, 224

[56] References Cited

U.S. PATENT DOCUMENTS

| | | | |
|---|---|---|---|
| 2,816,309 | 12/1957 | Worth et al. | 222/390 |
| 2,935,191 | 5/1960 | Leshih | 401/75 |
| 4,171,057 | 10/1979 | Gach | 215/211 |

*Primary Examiner*—Houston S. Bell, Jr.
*Attorney, Agent, or Firm*—Martha G. Pugh

[57] ABSTRACT

An improved dispenser for cosmetic stick solids such as deodorants constructed to be filled in either normal or inverted position. This dispenser is cylindrical having walls of substantially uniform diameter, an open top, and substantially closed bottom. The dispenser is constructed so that the dispensing means is either pushed up manually, or propelled by a screw-mechanism. In the latter case a long screw is mounted in a central opening in the bottom, and continues along the axis of the cylinder. The cap of the dispenser may assume either of two forms, a snap-on type, or a screw-on type, each exhibiting an air-tight seal. The snap-cap is constructed to include a plurality of cams which operate in conjunction with similar members on the mouth of the cylindrical container to provide relative ease in opening and closing the snap-cap.

The dispenser is designed to be filled in a conventional manner from the opening in the top, or, alternatively, from a hole in the bottom of the cylindrical container. In the latter case an inside liner disposed between the cap and the mouth of the cylindrical container retains the product during the filling process.

19 Claims, 8 Drawing Figures

DISPENSER FOR STICK SOLIDS

BACKGROUND OF THE INVENTION

This invention relates, in general to improved stick dispensers; and more particularly to improved dispensers for cosmetic stick solids.

Heretofore, dispensers were filled with product through the mouth of the cylindrical container, this also being the area from which the product is applied. This top-filling process results in inefficiency, as the cap can not be placed on the dispenser until the container has been filled and the product cooled. Also, after cooling, the upper surface of the so filled product has a rough and uneven shape in its area of application. Additionally, due to settling, the upper surface of the product may have a concave shape, reducing the aesthetic and utilitarian function of the stick product.

A further problem with prior art stick dispensers of the type described is that the product's useful life is reduced due to contact with air entering the cylindrical container between the cap and the upper opening which tends to dry-out the stick product. Also, in order to ease the slidability of the product, it has been customary in the prior art to form cylindrical dispensers with walls which are characterized by a substantial taper in the direction of the base. Thus, as the product is moved up the container, a gap is formed between the stick product and the inner cylinder walls, further reducing product life due to exposure to air.

Additionally, air-tight snap-on caps require a substantial amount of pressure to open and close them properly. Often, the user, failing to exert the necessary pressure, ineffectively closes the cap, thus allowing air to enter the dispenser; or, when he closes the container properly, the snap-fit results in a closure which is difficult to re-open.

SUMMARY OF THE INVENTION

It is therefore the broad object of this invention to provide a sealed dispenser for stick solids which is more economical and efficient to produce, and results in a product with a longer useful life than similar types of devices disclosed in the prior art.

A further object is to provide a stick dispenser which can be operated with relative ease.

An additional object is to provide a stick dispenser which can be filled from an inverted position.

A still further object is to provide a stick dispenser whose product will have a longer useful life, by sealing the product from the air.

These and other objects are realized in a sealed dispenser for stick solids which comprises cylindrical walls of uniform diameter having substantially no taper, thereby eliminating spaces between the product stick and the inner cylinder wall as the stick is pushed up through the cylinder. The combination of the present invention includes a cap, which may be snapped on or screw fitted, both types forming an air-tight seal with the inner wall of the cylindrical container. In each case, the caps are constructed to have an extended skirt which may include an internal surface which provides an inwardly directed flange disposed at a 45° angle to the top edge of the cylinder wall. This relationship forms a one-point tangential seal between the mouth of the cylindrical container and the surface of the inner cap flange, thus further sealing against air leaking into the dispenser. Additionally, the snap-on cap is constructed in one embodiment, to include a plurality of cams which operate in conjunction with similar members on the mouth of the cylindrical container, allowing for ease in opening and closing the container.

Furthermore, as an alternative to the conventional method of top-filling, the dispenser is constructed to be filled from the bottom through a small hole at the base of the cylindrical container. When the device is filled from the bottom, an inside liner is placed between the cap and the mouth of the cylinder which acts as a retainer for the product during the filling process. The inside liner or retainer forms the top of the stick product to any desired shape, preferably with a convex upper surface at the area of application, so that the stick product will have a more aesthetic and utilitarian appearance. The cap may be placed on the dispenser before filling to make the process more efficient.

DETAILED DESCRIPTION OF THE INVENTION

Figure 1:
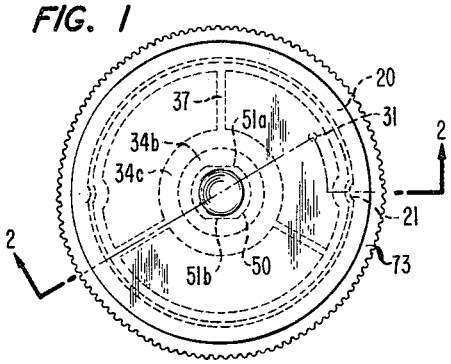
FIGS. 1 and 2 show, respectively, a top plan view and vertical section of the screw-up stick dispenser of the present invention, including a screw-on cap, which may be filled in the inverted position.
Figure 2:
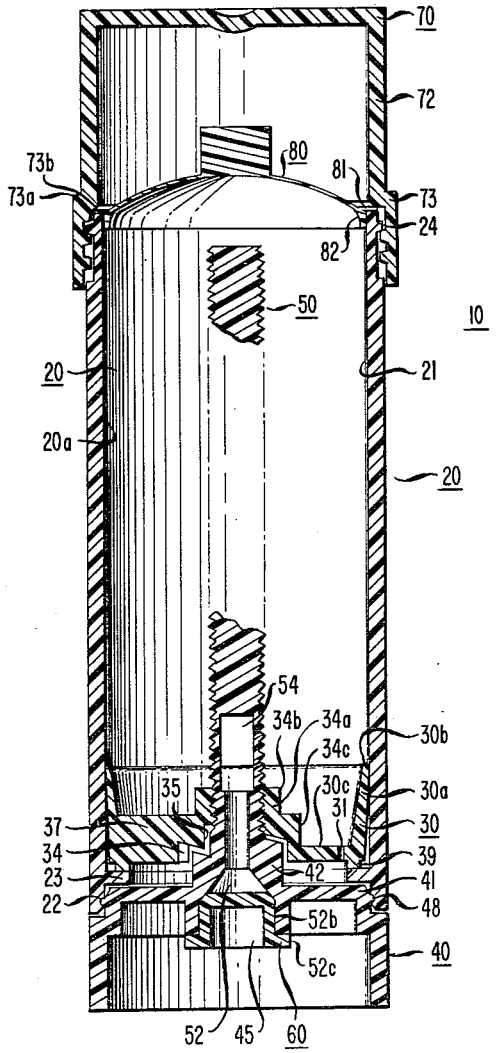

Referring to FIGS. 1 and 2, dispenser 10 is a screw-type stick dispenser with a screw-on cap which is constructed to be filled while in an inverted position. Dispenser 10 comprises a container 20, a plunger 30, a screwknob 40, a threaded stem 50, a plug 60, all formed of rigid plastic, such as for example, polypropylene, and a screw-cap 70 and an inside retainer top 80, which may be formed of a less rigid plastic, such as polyethylene.

In the presently-described illustrative embodiment, cylindrical container 20 is 9.5 centimeters high; and of a uniform diameter with substantially no variation in diameter between the top and bottom. The walls of container 20 are substantially perpendicular to the horizontal axis of dispenser 10, so that the inner diameter of dispenser 10 does not vary more than, say, about 0.005 centimeters at any point along the vertical axis, and the angular deviation between the upper and lower ends never exceeds, say, about 0.2°. The inside diameter measures 3.35 centimeters, and the outside diameter, 3.55 centimeters, giving container 20 a wall thickness of 0.20 centimeters. Projecting inwardly from the inside wall 20*a* of container 20 is a pair of diametrically-opposed vertical ribs 21 running the length of the container, substantially parallel to its principal axis. Ribs 21 are 0.25 centimeters wide and project 0.25 centimeters from inside wall 20*a*. These ribs engage corresponding vertical grooves in plunger 30, preventing the plunger from rotating within container 20.

At its upper end, container 20 has outside threads which comprise a male screw-member 24. This threaded portion extends 0.875 centimeters in an axial direction and is structured to cooperate with screw-cap 70 which will be described hereinafter.

Located 0.375 centimeters above the lower end of container 20 is an annular lip 23 which projects horizontally 0.375 centimeters from inside wall 20*a*. Lip 23 acts as a platform to seat plunger 30 at the base of dispenser 10.

Plunger 30 comprises a circular cup having a peripheral upwardly-directed flange 30*a*, the outside diameter of which is 3.55 centimeters at its base, widening to an outside diameter of 3.61 centimeters at its upper edge 30*b*. Plunger 30, being formed of flexible material such as, for example, polypropylene, may be force-fit into the smaller-diametered container 20, its natural resiliency allowing its outer diameter at upper edge 30*b* to be compressed from 3.61 centimeters as formed to an outside diameter of 3.55 centimeters when inserted in container 20. Thus, the upper edge 30*b* of flange 30*a* exerts a pressure against inside wall 20*a*, providing a seal at any point therealong. The peripheral flange 30*a* is 1.3 centimeters high having a thickness of 0.17 centimeters at base 30*c* of plunger 30, and tapering to 0.07 centimeters at upper edge 30*b*. Base 30*c*, which is substantially horizontal, has three air holes 31 which are 0.10 centimeters in diameter and symmetrically disposed in base 30*c* at radial distances of 1.42 centimeters, each, from the center point of base 30*c*. Air holes 31 allow air to escape during the filling process, thereby preventing air bubbles from forming.

Also symmetrically disposed on base 30*c* inside cup 30 are 3 radially-extending vertical partitions 37 which are 0.675 centimeters high and 0.15 centimeters thick. These partitions, which extend from the inner surface of flange 30*a* to the center of plunger 30, serve to prevent the solid from rotating within dispenser 10 when in use.

Base 30*c* of plunger 30 has a centrally-disposed opening 34 which has a diameter of 1.5 centimeters. Extending up axially from base 30*c* is cylindrical flange 34*a* having a height of 0.82 centimeters and a uniform wall thickness of 0.20 centimeters. At a height of 0.42 centimeters cylindrical flange 34*a* is indented to an outside diameter of 1.12 centimeters. Indentation 34*b* has a height of 0.50 centimeters and is internally threaded to accommodate screw-stem 50 described hereinafter. The lower portion 34*c* of cylindrical flange 34*a* has four symmetrically disposed helical threads 35 protruding 0.40 centimeters from its inside wall. Each helical thread 35 tapers in height in an axial direction, terminating in a vertical stop surface (not shown) from which the next succeeding helical thread is started; so that the four helical surfaces are disposed in a face-to-end relationship around the inner wall of flange 34*a*. Cylindrical flange 34*a* with helical threads 35 is constructed to accept helical collar 42 of screw-knob 40 when plunger 30 is seated at the base of container 20.

On the underside of base 30*c* of plunger 30 is an annular downwardly extending projection 39, having a rectangular cross-section 0.20 centimeters wide by 0.10 centimeters high, having an inside diameter of 2.98 centimeters. Projection 39 functions to seat plunger 30 on annular lip 23 of container 20. The outside wall of flange 30*a* has two diametrically opposed vertical grooves 0.25 centimeters deep, which engage ribs 21, preventing rotation of plunger 30 within container 20.

At the base of dispenser 10, screw-knob 40 serves as a closure for the container 20. The latter is shaped like an inverted cup, with a ribbed cylindrical side wall 1.28 centimeters high, having an inside diameter of 3.0 centimeters, and a wall thickness of 0.25 centimeters. The narrower upper portion 41 of screw-knob 40 which projects 0.40 centimeters in co-axial relation to the major axis of container 20, has a diameter of 3.65 centimeters, and is provided with an annular ring 48 which extends an additional 0.06 centimeters in a diametrical direction. Ring 48 fits into a corresponding annular groove 22 in inside wall 20*a*. This ring and groove combination holds screw-knob 40 to container 20, yet allows relative rotation.

Co-axial with upper portion 41 is a helical collar 42 which is disposed to engage the inside surface formed by cylindrical flange 34 and helical threads 35 of plunger 30. Helical collar 42 is composed of two helical threads which taper in height in a downward axial direction terminating in a vertical stop surface 0.50 centimeters high, from which the next succeeding helical thread is started. The two helical threads are disposed in a face-to-end relationship at the base of stem 50.

Helical collar 42 is constructed so that when plunger 30 is seated at the base of container 20, the respective vertical stop surfaces of collar 42 and helical member 35 will be in contact, preventing screw-knob 40 from being rotated in an improper direction, preserving the screw-threads at the base of screw-stem 50.

Centrally located in the base of the inverted cup of screw-knob 40 is a circular recess 45, which is 1.25 centimeters in diameter, and extends in a frusto-conical relation up through helical collar 42, forming the hollow base 52 of screw-stem 50. The latter extends up from helical collar 42 and through central opening 34 of plunger 30. Screw-stem 50 is an upright, threaded shaft, 8.60 centimeters high, integrally formed with screw-knob 40. A cross-section of stem 50, shown in FIG. 1, reveals that its shape is relatively circular with diametrically-opposed flattened sides 51*a* and 51*b*, having a diameter of 0.78 centimeters, as measured between flattened sides 51*a* and 51*b*, and 0.63 centimeters as measured between the circular sides. (See FIG. 1.)

Screw-stem 50 is solid at its upper end. At a point 6.5 centimeters below the upper edge of stem 50, there is an opening 54 of rectangular cross-section. The latter, which is cut through the flattened sides 51*a* and 51*b* of stem 50, is 0.95 centimeters high and 0.45 centimeters wide. Stem 50 is then hollow below rectangular opening 54 for its remaining length.

The hollow frusto-conical hollow base 52 and lower section of stem 50, along with rectangular opening 54, allow molten product to be poured into the stem, while container 20 is in inverted position, thereby filling container 20, the solidifying product being retained by a retainer cap 80 described hereinafter. Cup-shaped plug 60, having an outer diameter of 1.25 centimeters, an inner diameter of 0.70 centimeters and an axial dimension of 0.50 centimeters, is designed to snap snugly into the cylindrical recesses 45 and hollow base 52, sealing the lower end of container 20, thereby preventing leakage of the molten product out through the stem.

Covering container 20 at its upper end, is screw-cap 70 which is roughly in the form of an inverted cup, having an inside diameter of 3.78 centimeters and an outside diameter of 4.15 centimeters. Hollow cylindrical cap 70 extends 2.55 centimeters from top-to-bottom in an axial direction, not including an internally screw-threaded, externally ribbed, shoulder 73 which has an additional axial width of 0.25 centimeters.

Upper surface 73*a* of shoulder 73 extends out perpendicularly from side wall 72. The corresponding inner surface 73*b* is beveled at a 45° angle between the internal surface of side wall 72, and the internally screw-threaded shoulder 73, enabling cap 70 to seal tangentially with the top edge of container 20. This one-point seal between cap 70 and upper open end of container 20, along with the plunger seal at the lower end of container 20, keeps air out of the latter, thus increasing the shelf life of the product by reducing the drying out process.

Disposed between cap 70 and container 20 is retainer top 80; which in the present embodiment is dome-shaped, but can be formed in any desired shape, subsequently forming the top of the hardened product in a shape which has a more aesthetic and utilitarian appearance. An annular flange 81 extending out 0.20 centimeters laterally from the edge of the dome seats on the top edge of container 20 between the latter and screw-cap 70. The position of flange 81 and the position of lip 82, which extends verticallY downward 0.10 centimeters from the top edge of the container 20 so as to engage its inner surface, in no way interferes with the one-point seal between flange 81 and the 45° angular surface 73*b*. When screw-cap 70 is screwed down on to container 20, the seal will hold retainer top 80 in place.

This embodiment operates in the following manner:

With the plug 60 removed, and retainer top 80 and cap 70 in place, dispenser 10 may be filled from the inverted position, through the hollow section of screw-stem 50. Molten liquid product poured into stem 50 flows through rectangular opening 54 into container 20. Retaining top 80, held in place by cap 70, will retain the liquid product and allow it to solidify, forming a surface of desired shape. Air expelled during the filling operation will escape through holes 31 in plunger 30, which in the presently-described embodiment are three in number. When dispenser 10 is filled and the product cooled and solidified, plug 60 may be inserted. Now, the stick dispenser is ready for use. Due to the seal created between cap 70 and container 20 air cannot enter cylinder 20 to dry-out the product. When the dispenser is in use, retaining top 80 may be discarded, the hardened product assuming the same shape as the top. In order to use dispenser 10, screw-knob 40 is turned to the right, thereby turning screw-stem 50, causing plunger 30 to move up screw-stem 50 projecting the top surface of the solid product. As the product is used up, the seal between the diameter walls of container 20 and the tapered inner flange 31 of plunger 34 will prevent air from entering, thereby preventing the product from drying out.

Figure 3:
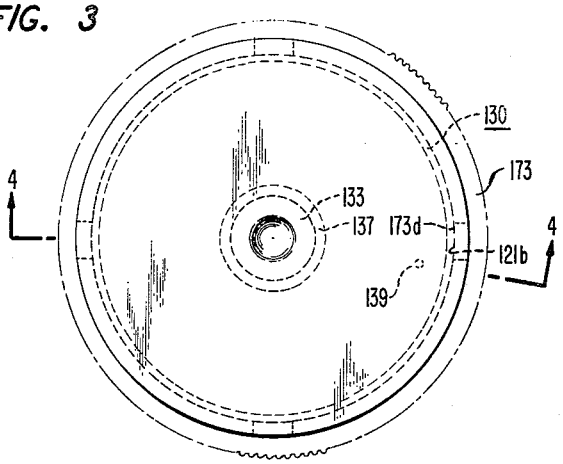
FIGS. 3 and 4 show, respectively, a top plan view and vertical section of the push-up stick dispenser of the present invention, including a cam-action snap-on cap, which may be filled in the inverted position.
Figure 4:
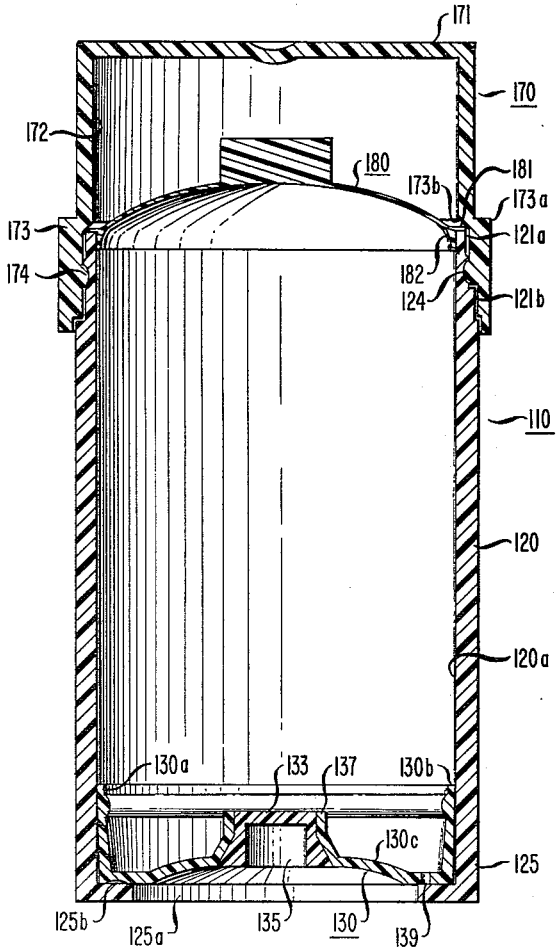

FIGS. 3 and 4 respectively show, in top plan view and vertical section, a push-up type stick dispenser. Dispenser 110 comprises a container 120 and snap-on cap 170 which may be made of any rigid plastic, say, for example polypropylene. Also, dispenser 110 has a plunger 130, which may be formed of a less rigid plastic, say, for example polyethylene.

Container 120 is of cylindrical form having a height 7.6 centimeters and a uniform diameter, with substantially no variation between top and bottom, the walls of container 120 being substantially parallel to the principal axis of dispenser 110 so that the inner diameter does not vary more than, say, about 0.005 centimeters at any point along the principal axis, and the angular deviation between the upper and lower sidewalls ends never exceeds, say, about 0.2°.

The inside diameter of dispenser 110 is 4.15 centimeters; and the outside diameter is 4.63 centimeters; thus, container 120 has a uniform wall thickness of 0.24 centimeters. At its upper end, container 120 is structured to cooperate with snap-on cap 170, which will be described hereinafter. The indented upper portion 121*a* of container wall 120 consists of the upper 0.65 centimeters wherein the outside wall is cut back to a wall thickness of 0.13 centimeters.

Located adjacent to and covering the upper portion 121 of container 120 is snap-on cap 170 which is roughly in the form of an inverted cylindrical cup. Snap-on cap 170 has an outside diameter of 4.6 centimeters and an inside diameter of 4.23 centimeters. Extending 4.38 centimeters in an axial direction from top 171 of cap 170 is the cylindrical cap wall 172, which includes an annular internally ribbed shoulder 173 at the lower end, which extends the outside diameter of cap 170 to 4.87 centimeters. This provides a wall thickness of 0.25 centimeters for the upper 0.75 centimeters, which is indented to a wall thickness of 0.13 centimeters for 0.40 centimeters above the lower edge. At a level about 0.50 centimeters below upper edge surface 173*a* of shoulder 173, annular rib 174, is disposed around the inner periphery of shoulder 173, cutting 0.08 centimeters into the inside wall and engaging a corresponding groove 124 in the outside wall of upper indented rim portion 121 of container 120. This relationship between each of rib 174 and the corresponding groove 124 forms the snap-fit, sealing the container 120. It is noted the rib and groove relation can be in an alternate combination i.e., the rib may be on the container while the groove is on the cap. This alternate combination is shown, for example, in FIG. 7.

Upper surface 173*a* of shoulder 173 extends out perpendicularly from side wall 172. The corresponding inner surface 173*b* is internally beveled at a 45° angle from side wall 172, forming an edge which enables cap 170 to seal tangentially with the top edge of container 120. This peripheral seal, along with the plunger seal, keeps air out of container 120, thus increasing the shelf life of the product by reducing the drying-out process.

Disposed between cap 170 and container 120 is a retainer top 180. In the present embodiment retainer top 180 is dome-shaped, but can be formed in any shape desired, thus forming the top of the hardened product as disclosed in the previous embodiment. Annular flange 181 extending 0.10 centimeters horizontally outward from the edge of the dome, seats on the top edge of container wall 120 between the latter and on internally beveled edge 173*b* of cap 170. The flange 181 and the lip 182, which extends vertically downward 0.10 centimeters from the top edge of the container wall 120, are so positioned as not to interfere with the one-point tangential seal of cap 170.

Figure 7:
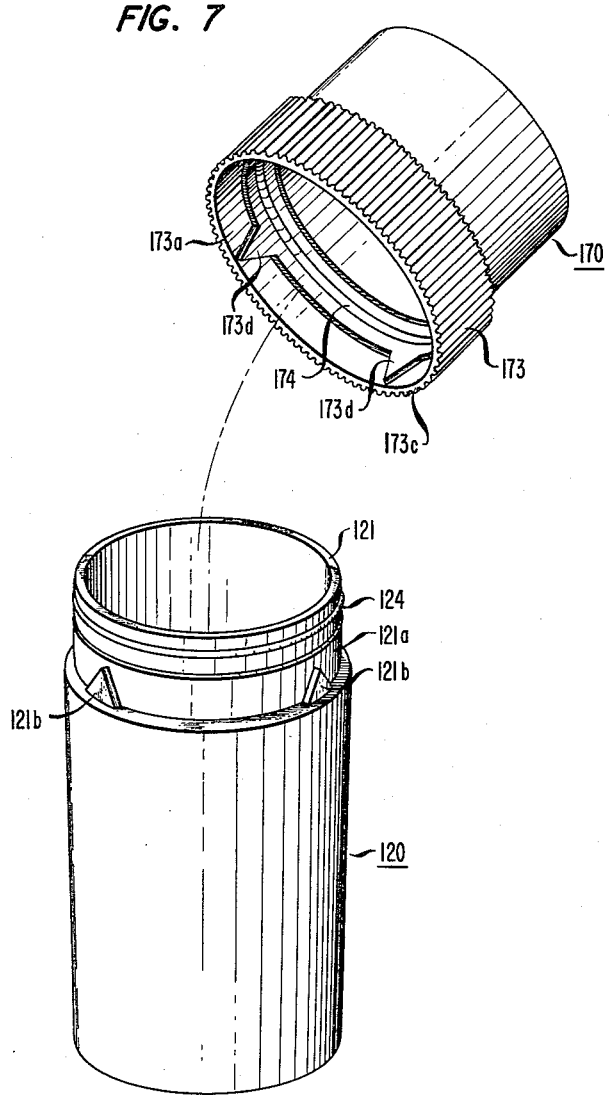
FIG. 7 is a perspective view of the push-up stick dispenser, and cap in the removed position, especially showing the cam-members.

Referring to FIG. 7, there is shown, in perspective, the cap 170 and container 120.

Symmetrically disposed on the inside wall 173*a* adjacent lower edge 173*c* of shoulder 173, and projecting downwardly are four upper cam-members 173*d* designed to cooperate with four similar symmetrically disposed lower cam-members 121*b*, for ease in snapping and unsnapping cap 170.

Each of cams 173*d* and 121*b* are in the shape of a V and an inverted V, respectively, each having a widest portion 0.75 centimeters across, and extending 0.40 to its vertex which forms an angle of 45°. Upper cam-members 173*d* protrude 0.15 centimeters from the inside wall 173*a* of shoulder 173. Similarly, lower cam-members 121*b* extend 0.15 centimeters from the outside wall 121*a* of upper portion 121 of container 120.

When cap 170 is placed over container 120, and if the upper and lower cam-members meet vertex-to-vertex, upper cam-members 173*d* will slide to one side down the angularly disposed sides of lower cam-members 121*b*, snapping the cap in place. If the cam-members do not meet, the cap will snap on without being affected by the cam-members.

To remove cap 170, container 120 is held stationary, and the cap can be rotated in either direction. The upper cam-members 173*d* will slide along the outside wall of the container until they contact lower cam-members 121*b*. The oppositely directed 45° angular sides of the cam-members, working in reciprocal relation, will cause the upper cam-member to ride up the surface of the lower cam-member, forcing cap 170 off of container 120. The cam action, as described, allows the cap to be removed with relative ease, as instead of having to pull the cap off, it may be removed by merely rotating the cap, and engaging the cam-members.

Referring again to FIGS. 3 and 4, the lower end of container 120 is partially closed by base 125, which has a centrally-located circular opening 125*a*, which is 3.28 centimeters in diameter, providing an inwardly-directed annular flange 125*b*. Opening 125*a* allows the manipulation of plunger 130 which seats at the base of container 120.

Plunger 130 comprises a circular cup having a peripheral upward-directed flange 130*a* the outside diameter of which is 4.15 centimeters at its base and widening to an outside diameter of 4.20 centimeters at its upper edge 130*b*. As in the previous embodiment, plunger 130 is formed of flexible material, such as, for example, polyethylene, and may be force-fit into the smaller-diametered container 120. The natural resiliency of the material used for plunger 130 allows the outer diameter of plunger 130 at upper edge 130*b* to be compressed from its normal diameter of 4.20 centimeters to an outside diameter of 4.15 centimeters, when inserted in container 120. The upper edge 130*b* of flange 130*a* exerts pressure against inside wall 120*a*, thus providing a seal at any point therealong.

The peripheral flange 130*a* is 1.1 centimeters high, having a thickness of 0.15 at base 130*c* of plunger 130, and tapering to 0.10 centimeters at upper edge 130*b*. Base 130*c* is dome-shaped, rising 0.20 centimeters in the center allowing for ease of manipulation. Dome-shaped base 130*c* of plunger 130 has a centrally-disposed opening 135 which is used to fill dispenser 110 from the inverted position. Opening 135 has a diameter of 1.25 centimeters. Extending upward co-axially from the inner edge of opening 135 is an inwardly directed annular nipple 137 which has a uniform wall thickness of 0.10 centimeters and an outside diameter of 1.50 centimeters at its base. Nipple 137 then tapers to an inside diameter of 0.90 centimeters at a height of 0.25 centimeters, thereafter maintaining a uniform inside diameter of 0.90 centimeters for the remaining 0.25 centimeters at the upper end.

In order to prevent product from leaking out of opening 135, and to further prevent air from entering container 120, cup-shaped plug 133 is inserted into opening 135 subsequent to filling. The latter may be constructed of polypropylene, and is designed to fit snugly into opening 135. Plug 133 has an outside diameter of 1.25 centimeters, at its base, tapering to an outside diameter of 0.95 centimeters at a height of 0.30 centimeters. It thereafter maintains this uniform outside diameter for the remaining 0.30 centimeters. It is noted that the outside diameter of plug 133 is substantially identical to the inside diameter of opening 135. This relationship allows plug 133 to be force-fit into opening 135, sealing container 120 at the area of contact.

An additional feature of plunger 130 is the insertion of one or more small air holes 139 in the base of plunger 130, each of which is 0.10 centimeters in diameter and centered approximately 1.75 centimeters from the central axis of plunger 130. When the liquid product is poured into container 120 through opening 135, air hole 139 allows the air to escape preventing air bubbles from forming during this filling process. Air hole 139 will be sealed by the cooled solidifed product filling the hole.

This enbodiment operates in the following manner:

With the plug 133 removed, and retainer top 180 and cap 170 in place, dispenser 110 may be filled from the inverted position, through opening 135 in plunger 130. Molten liquid product is poured into container 120 filling the body. Retainer top 180, held in place by cap 170, will retain the liquid product and allow it to solidify forming the surface of desired shape. Air expelled during the filling operation will escape through one or more air holes 139 in plunger 130. When dispenser 110 is filled and the product cooled and solidified, plug 133 is inserted. Now the stick dispenser is ready for use. Due to the seal created between cap 170 and container 120 air cannot enter dispenser 110 to dry-out the product. When the dispenser is in use, retainer top 180 may be discarded, the hardened product assuming the same shape as the top. In order to use dispenser 110, cap 170 is removed, aided by the cam-action between cap 170 and container 120, as previously described. Plunger 130 is manipulated by the user through the opening 125*a*. The plunger 130 and the product are pushed up inside of the container until the desired amount product is exposed. The product is then administered. Inasmuch as the inside cylindrical wall 120*a* has a uniform diameter, plunger 130 seals against it at any position, so that when cap 170 is replaced, air is sealed away from the product, thereby increasing its useful life.

Figure 5:
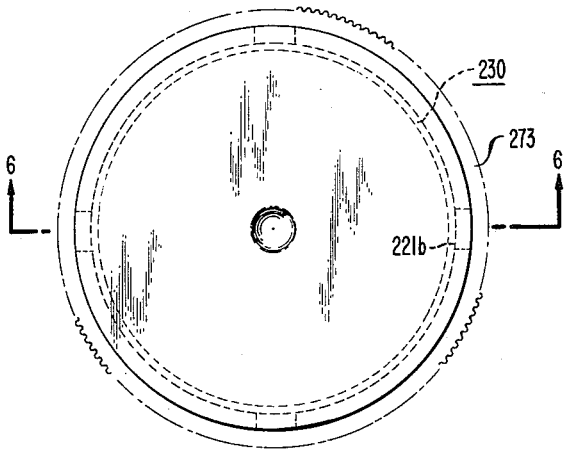
FIGS. 5 and 6 show, respectively, a top plan view and vertical section of the push-up stick dispenser of FIGS. 3 and 4, modified so that it may be filled in the upright position.
Figure 6:
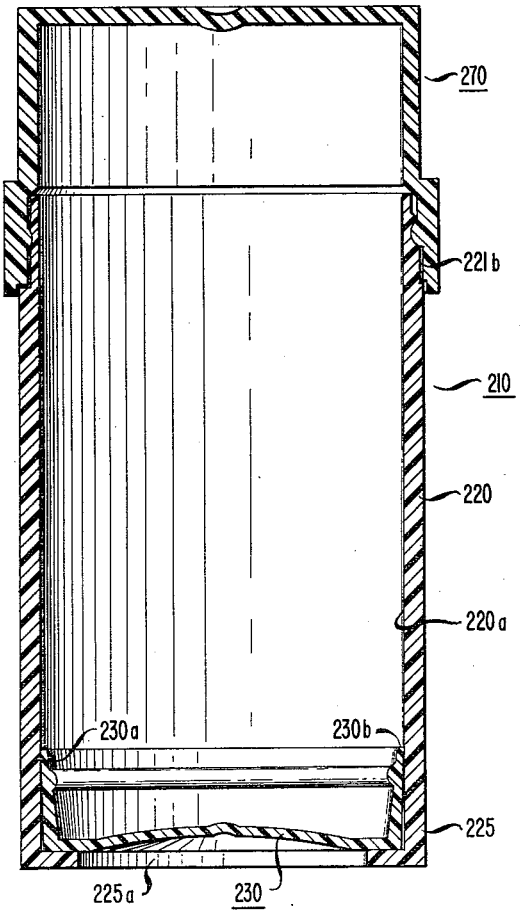

FIGS. 5 and 6 show a modification of the push-up stick dispenser of FIGS. 3 and 4. In the present embodiment, the container is filled in the upright position eliminating the need for an inside retainer top or an opening in the plunger.

The dispenser of the present embodiment is substantially similar to that of the previous embodiment. For simplification of description with reference to FIGS. 5 and 6, 100 will be added to the designating numerals of the elements of FIG. 5, corresponding elements being understood to be substantially similar to those of FIGS. 3 and 4, unless otherwise specified.

The principal feature of the present embodiment is cup-shaped plunger 230, which is modified to eliminate the axial opening and annular inner nipple of the plunger of the previous embodiment. Plunger 230 comprises a circular cup having a peripheral upwardly-directed outer flange 230*a* with dimensions similar to those of the previously described plunger of FIG. 4. As in the previously described embodiments, plunger 230 is formed of a flexible material, say, polyethylene, and may be force-fit into the smaller-diametered container 220. The natural resiliency of the material used for plunger 230 allows its outer diameter at upper edge 230*b* to be compressed when inserted in container 220. Thus upper edge 230*b* of flange 230*a* is caused to exert a pressure against inside wall 220*a*, providing a seal at any point along container 220.

The base 230*c* is dome-shaped, the maximum height of the dome being 0.20 centimeters. In addition to the elimination of the axial opening in base 230*c*, air holes 139 of FIG. 4 are also eliminated, as in the top fill process, air can escape through the top of container 220.

This embodiment operates in the following manner:

With cap 270 removed, container 220 is filled with heated liquid product through its upper opening. Air expelled during the filling operation is also vented through this upper opening. Cap 270 is then replaced, and the dispenser is now ready for use. Due to the seals created between cap 250 and container 220, and between plunger 230 and inside wall 220*a*, air cannot enter dispenser 210 to dry-out the product.

In order to use this dispenser, cap 270 is removed, aided by the cam-action of the V-shaped cams on the inside of cap 270 and on the lip of container 210, which are similar to those previously described with respect to FIG. 7. Plunger 230 is manipulated by the user through opening 225*a*. The product is then exposed and administered. After use of the dispenser, cap 270 is again snapped-on, sealing the container.

Figure 8:
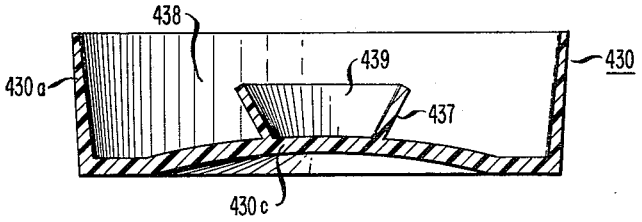
FIG. 8 shows a vertical section of the plunger of FIGS. 3, 4, 5, and 6, which is modified for use with an alcohol based product.

FIG. 8 shows a modification 430 of the push-up type plungers 130 and 230 of FIGS. 4 and 6, respectively. The principal modification is the addition of an inner annular flange 437, which divides plunger 430 into an outer annular chamber 438, and an inner cup-shaped chamber 439. This plunger 430 is used in connection with a dispenser employing an alcohol-based product, which is subject to shrinkage due to evaporation of the alcohol. The angular relationship between inner annular flange 437 and the outer annular flange 430*a* serves to hold the product in place in plunger 430.

In the present embodiment, plunger 430 is of the type used in a top-fill dispenser. It is contemplated that a further modification of the base 430*c*, to include an opening and plug, as shown and described with respect to FIGS. 5 and 6, can be constructed for use in connection with a bottom-fill dispenser.

Base 430*c* and outer flange 430*a* of plunger 430 are substantially similar to the corresponding elements of plunger 230 of FIG. 6. Disposed at a radius of 2.20 centimeters from the center of plunger 430 is the inner annular flange 437, which projects to a height of 1.50 centimeters, and has a wall thickness of 0.25 centimeters. Inner annular flange 437 extends from base 430*c* at an angle, of say, about 15° as measured from the major vertical axis, thereby dividing plunger 430 into 2 chambers. The first is the outer annular chamber 438, whose cross-sectional base is 1.40 centimeters wide, tapering to a width of 1.20 centimeters at its upper edge. The second is the cup-shaped chamber 439 whose cross-sectional base is 4.20 centimeters wide, increasing to a width of 5.10 centimeters at its upper edge.

The tapered form of outer annular chamber 438 allows plunger 430 to secure the alcohol-based product and prevent the latter from becoming displaced when in use. The dispenser, with plunger 430, may then be used in the same manner as dispenser 210 of FIG. 6.

The present invention discloses various embodiments of stick dispensers including, push-up and screw-up type, which can be filled in either the inverted or normal position. Also, shown are various cap closures including a snap-on cap and a screw-on cap. While all combinations are not shown, it is contemplated that each type of stick dispenser may employ either filling method, as well as either type cap. For example, a screw-on cap of FIGS. 1 and 2 may be employed in either push-up dispenser of FIGS. 4 or 6.

It is also contemplated that the two cap types shown, both employing the one-point tangential seal, may be used on other containers, not limited to the stick dispensers shown.

In addition, it will be understood that the invention is not to be construed as limited to the specific forms or dimensions given herein by way of example, but only by the scope of the appended claims.

What is claimed is:

1. A device constructed to enclose and dispense solid or semi-solid stick product, comprising in combination:

a hollow cylindrical container having walls of substantially uniform diameter wherein the angle between the inner wall of said container and the principal axis of said container does not exceed about 0.2°, an open upper end for the dispensing of said product, and the base end of which is at least partially closed;

a slidable non-rotatable cup-shaped plunger mounted in the base end of said cylindrical container substantially concentric with the axis of said container and having an annular, upwardly projecting peripheral flange, said flange constructed and arranged to move in sealed slidable relation to the inner wall of said container and to form a vapor-tight seal against said wall for containing said product;

a removable cap attached to, and sealing against the upper end of said container above said product;

means for filling said container and said cup-shaped plunger with a molten or semi-molten product which assumes a solid or semi-solid form;

means cooperating with said plunger for progressively propelling said solid or semi-solid product axially toward said open upper end, wherein said projecting means comprises a mechanism for the upward vertical displacement of said plunger within said container.

2. The combination in accordance with claim 1 wherein:

said removable cap is substantially cylindrical in form and is formed to include a peripheral skirt having an internal flange forming a 45° angle with the cylindrical wall of said cap, said flange constructed and arranged to seal against said upper outer end of said container.

3. The combination in accordance with claim 1 wherein:

said wall of said container has an inner diameter which does not vary more than, say, about 0.005 centimeters between said upper and lower ends.

4. The combination in accordance with claim 1 wherein the projecting means for said plunger comprises a mechanism for manually displacing said solid or semi-solid product in an upward or outward direction.

5. The combination in accordance with claim 1 wherein the projecting means for said plunger comprises screw-means, said screw-means comprising in combination:

a centrally disposed opening in said plunger, wherein said opening is internally screw-threaded;

a screw-threaded stem mounted in axial relation in the base of said container and projecting upwardly in operative relation to screw-threaded opening;

a cylindrical screw-knob attached in an axial relation to the lower end of said stem adjacent the base of said container;

wherein said screw-stem is constructed and arranged to rotate in direct response to the manual rotation of said screw-knob; and wherein said plunger is propelled by said screw-threaded stem operating through said opening to move in an axial direction along the interior of said cylinder in response to rotation of said screw-knob.

6. The combination in accordance with claim 1 wherein:

said cap is in the form of an inverted cup having a depending annular skirt, said cap being fastened in closed relation to said container by resilient snapping means comprising an annular ring disposed near the lower inner edge of said skirt, said ring constructed and arranged to engage an annular groove disposed near the upper outer edge of said container.

7. The combination in accordance with claim 1 wherein:

said cap is in the form of an inverted cup having a depending annular skirt, being fastened in closed relation to said container by screw-means comprising internal screw-threads disposed near the lower inner edge of said skirt, constructed and arranged to engage external screw-threads disposed near the upper outer edge of said container.

8. The combination in accordance with claim 1 wherein:

said means for filling said container comprises said open upper end through which molten product is poured and allowed to solidify.

9. The combination in accordance with claim 1 constructed to be filled in inverted position wherein:

said means for filling said container comprises in combination:

a centrally disposed opening in said plunger through which molten product is poured into said container when the same is held in inverted position, and allowed to solidify;

a removable retainer cover having its peripheral edge clamped between the mouth of said container and an internally directed annular flange of said cap, said removable retainer constructed and arranged to retain said molten product; and a plug designed to seal said opening in said plunger after said container is filled;

wherein said molten product solidifies while said container is in inverted position assuming the shape of the inner surface of said removable retainer cover.

10. The combination in accordance with claim 4 wherein:

said means for filling said container in inverted position comprises in combination:

a hollow lower end including a central tubular intake leading into a hollow lower portion of said screw-stem, said hollow portion having a lateral opening through which said molten product flows into said container and allowed to solidify;

a retainer cover having its peripheral edge clamped between the upper peripheral edge of said container and an internally directed annular flange of said cap, said removable retainer cover constructed and arranged to retain said molten product;

a plug designed to seal said opening in said plunger after said container is filled; and wherein said molten product solidifies while said container is in inverted position assuming the shape of the inner surface of said removable retainer cover.

11. A device constructed in accordance with claim 1 to enclose and dispense solid or semi-solid product comprising in combination:

a hollow cylindrical container having an open upper end and a lower end which is at least partially closed;

a removable cap in the form of an inverted cup having a depending annular skirt attached to, and sealing against said upper outer edge of said container by resilient snapping means;

wherein said snapping means comprises an annular ring disposed near the lower inner edge of said skirt, constructed and arranged to engage an annular groove disposed near the upper outer edge of said container;

and wherein said resilient snapping means is engaged by cam-action means comprising in combination:

a plurality of V-shaped upper cams protruding from the inside wall, near the lower inner edge of said skirt;

a plurality of inverted V-shaped lower cams protruding from the outside wall near the upper outer edge of said container;

wherein, upon rotation of said cap relative to said container for removal, said upper cams are constructed and arranged to engage said lower cams in a side-by-side relation and ride upon said lower cams, thereby causing said cap to unsnap from said container, and whereby for replacing said cap on said container said upper cams are caused to ride down said lower cams and engage said lower cams in side-by-side relation thereby sealing said cap on said container.

12. The combination in accordance with claim 11 wherein the sides of said V-shaped upper and lower cams have an angular relation to one another approximating, 45°.

13. A method of opening a dispenser having its upper peripheral edge closed by an inverted cup-shaped snap-on cap having a depending annular skirt comprising the steps of:

holding said dispenser in a stationary position;

rotating said cap, including said skirt, in either direction relative to the upper peripheral edge of said container allowing at least one of a plurality of V-shaped upper cam-members, protruding from the inside wall of said depending annular skirt, to engage at least one of a plurality of inverted V-shaped lower cam-members protruding from the external upper edge of said dispenser;

wherein said rotation will cause the lateral edge of at least one of said upper cam-members to engage the lateral edge of at least one of said lower cam-members, further rotation causing said upper cam-member to rise up against said lower cam-member, causing said cap to be unsnapped from said dispenser.

14. The method in accordance with claim 13 wherein said slidable plunger is constructed to be propelled in an axial direction in said container by a screw-stem which moves in cooperative relation to a screw-hole centered in said plunger, the steps which comprise;

hollowing out the base of said container and the lower portion of said screw-stem to a length which extends a substantial distance beyond the inner surface of said plunger;

interposing a lateral opening in the wall of said hollow lower portion of said screw-stem, said lateral opening above the inner surface of said plunger; and injecting molten product into said container in inverted position through said hollow base and said lateral opening of said screw-stem, thereby forcing said molten product into the area between the inner surfaces of said plunger and said retainer cover through said hollow base and opening.

15. The method of filling a dispenser with molten product in accordance with claim 14 wherein:

said removable retainer cap may be formed with a convex upper surface thus forming the upper surface of said stick product.

16. The product by the process of claim 14.

17. The product by the process of claim 15.

18. The combination in accordance with claim 7 wherein said removable cap is in the form of an inverted cup having a depending annular skirt attached to, and sealing against said upper edge of said container by resilient snapping means comprising an annular ring disposed near the lower inner edge of said skirt, said ring constructed and arranged to engage an annular groove disposed near the upper outer edge of said container;

and wherein said resilient snapping means is engaged by cam-action means comprising in combination:

a plurality of V-shaped upper cams protruding from the inside wall, near the lower inner edge of said skirt;

a plurality of inverted V-shaped lower cams protruding from the outside wall near the upper outer edge of said container;

wherein, upon rotation of said cap relative to said container for removal, said upper cams are constructed and arranged to engage said lower cams in a side-by-side relation and ride upon said lower cams, thereby causing said cap to unsnap from said container, and whereby for replacing said cap on said container said upper cams are caused to ride down said lower cams and engage said lower cams in side-by-side relation thereby sealing said cap on said container.

19. The combination in accordance with claim 18 wherein the sides of said V-shaped upper and lower cams have an angular relation to one another, approximating 45°.

* * * * *

UNITED STATES PATENT AND TRADEMARK OFFICE

CERTIFICATE OF CORRECTION

PATENT NO. : 4,298,036
DATED : Nov. 3, 1981
INVENTOR(S) : William Horvath

It is certified that error appears in the above-identified patent and that said Letters Patent are hereby corrected as shown below: Column 12, cancel lines 51 through 69 and substitute therefore ---Claim 13. In a dispenser for solid or semi-solid stick product comprising in combination a hollow cylindrical container having an open upper end and a base which is at least partially closed, a slidable plunger with a centrally disposed opening, said plunger mounted in the base of said container, a removable cap closing said open upper end, a removable retainer cover clamped between said container and said cap, a plug disposed to seal the central opening in said plunger, and the method of filling said dispenser which comprises the steps of:

inverting said dispenser;

removing said plug from said central opening of said plunger;

filling said container through said central opening with said molten product;

replacing said plug; and allowing said product to solidify while said container remains in said inverted position.---

Column 13, Claim 15, line 21 change "14" to ---13---;
Column 13, Claim 16, line 25, change "14" to ---13---.

Signed and Sealed this

Ninth Day of February 1982

[SEAL]

Attest:

GERALD J. MOSSINGHOFF

Attesting Officer

Commissioner of Patents and Trademarks